United States Patent [19]

Coldren

[11] Patent Number: 4,643,507

[45] Date of Patent: Feb. 17, 1987

[54] ELECTRICAL TERMINAL WITH WIRE RECEIVING SLOT

[75] Inventor: Daniel R. Coldren, Enola, Pa.

[73] Assignee: AMP Incorporated, Harrisburg, Pa.

[21] Appl. No.: 726,873

[22] Filed: Apr. 25, 1985

[51] Int. Cl.[4] ..... H01R 11/20

[52] U.S. Cl. ..... 339/97 P; 339/19; 339/98; 339/99 R

[58] Field of Search ..... 339/19, 95 R, 96, 97 R, 339/97 P, 98, 99 R, 258 R, 258 P, 276 T

[56] References Cited

U.S. PATENT DOCUMENTS

| | | | |
|---|---|---|---|
| 3,617,983 | 11/1971 | Patton | 339/98 |
| 3,767,841 | 10/1973 | Anderson et al. | 339/97 C |
| 3,854,114 | 12/1974 | Kloth et al. | 339/97 R |
| 3,877,771 | 4/1975 | Jensen et al. | 339/19 |
| 3,895,852 | 7/1975 | Wasserlein, Jr. | 339/99 R |
| 4,116,522 | 9/1978 | Reynolds | 339/97 R |
| 4,118,103 | 10/1978 | Leidy et al. | 339/98 |
| 4,581,820 | 4/1986 | Zahn et al. | 339/97 P |

*Primary Examiner*—Gil Weidenfeld
*Assistant Examiner*—Paula A. Austin
*Attorney, Agent, or Firm*—Robert W. J. Usher

[57] ABSTRACT

An electrical terminal (8) stamped and formed in one piece into channel section, portions (14,14') of the channel walls remote form the base (12) being relatively inclined and having wire receiving slots (15,15') extending towards the base (12). At least one of the wall portions (14,14') being folded back towards the base (12) so that a hooked end of a wire (21) can be manually inserted through a slot mouth into the fold and the wire drawn across the terminal (8) into both slots (15,15') tension in the wire (12) resiliently flexing the wall portions (14,14') towards each other retaining the connection in stressed condition.

19 Claims, 11 Drawing Figures

ELECTRICAL TERMINAL WITH WIRE RECEIVING SLOT

The invention relates to electrical terminals of the type having a wire receiving slot into which a wire can be forced so that opposite edges of the slot grip the wire and establish a permanent electrical connection to the wire core.

Such terminals are well known and examples are disclosed in U.S. Pat. Nos. 4,116,522; 3,854,114; 3,895,852; and 3,617,983.

When wiring a panel or chassis board carrying a variety of electrical equipment, there is a requirement for wires to be rapidly and reliably terminated in such terminals and, preferably, in the field, by hand without recourse to tools.

According to one aspect of the invention, an electrical terminal is stamped and formed in one piece of metal into substantially channel section, portions of the channel walls remote from the channel base having, respectively, wire-receiving slots extending towards the base from mouths remote from the base, one of the wall portions being folded back at a free end.

In use of the terminal, an end of a wire can be inserted through a slot mouth into the fold, and the remainder of the wire drawn into and across the channel thereby bending the end into hook form and inserting the wire into both slots as a force fit. This resiliently flexes the wall portions relatively towards each other thereby maintaining the wire in tension. The end of the wire is trapped in the fold facilitating initial entry and retention of the wire in the adjacent slot. In this manner a termination can readily be made by hand in the relatively confined space of a panel board.

Preferably, the channel wall portions are divergent as they extend away from the base. This assists in establishing and maintaining a gripping force on the wire particularly on initially drawing the wire into the slots.

In particular example, the other wall portion is folded back towards the base and the relatively divergent channel wall portions are provided at free ends of parallel channel wall portions.

The or each slot may have opposite edges which converge as they extend away from the mouth assisting in providing a wedging action on the wire desirable to effect and maintain the termination. The convergent edges may extend to parallel edges at an end of the slot remote from the mouth. This facilitates the retention of stranded wires, individual strands being aligned in a single row gripped by the parallel edges.

According to another aspect of the invention, there is provided an electrical connection comprising a stamped and formed, one piece metal terminal of substantially channel section, portions of the channel walls remote from the base being relatively divergent as they extend away from the base and having, respectively, wire-receiving slots extending towards the base from mouths remote from the base; a wire received as a force fit in respective slots to extend across the channel in tension with the wall portions resiliently flexed towards each other by the wire, an end of the wire extending from a slot of in hooked fashion.

Examples of the invention will now be described with reference to the accompanying drawings in which.

Figure 1:
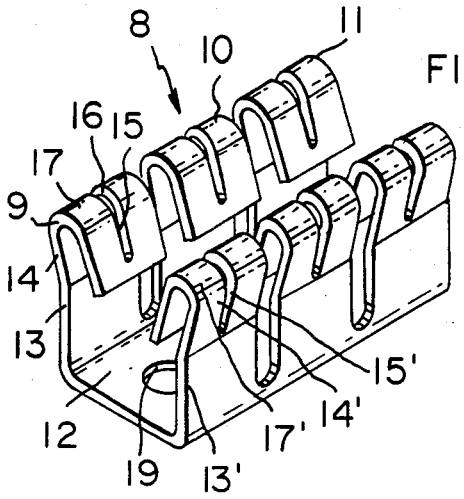
FIG. 1 is a perspective view of a first terminal according to the invention.
Figure 5:
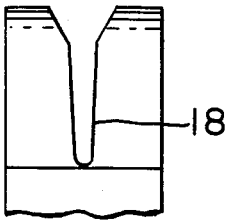
FIG. 5 is a fragmentary side elevation of the first terminal showing in particular the wire receiving slot.

As shown in FIGS. 1–5, the first example of terminal 8 is stamped and formed in one piece of metal into substantially channel section having three axially spaced wire receiving sections 9, 10 and 11. Each section has a base 12 upstanding from opposite sides of which are first, parallel wall portions 13,13′ which extend to second divergent wall portions 14,14′ folded back at their free ends towards the base 12. Wire receiving slots 15,15′ extend towards the base from mouths 16,16′ in the bight 17,17′ of the fold remote from the base 12. As shown in FIG. 5, the slots have opposite edges 18 which converge as they extend away from the base to provide a wedging action on a wire, assisting gripping, particularly during initial wire insertion and enabling the termination of solid wires of different gauges in a single terminal. Bolt receiving apertures 19 are provided in the base to secure the terminal to a board.

Figure 2:
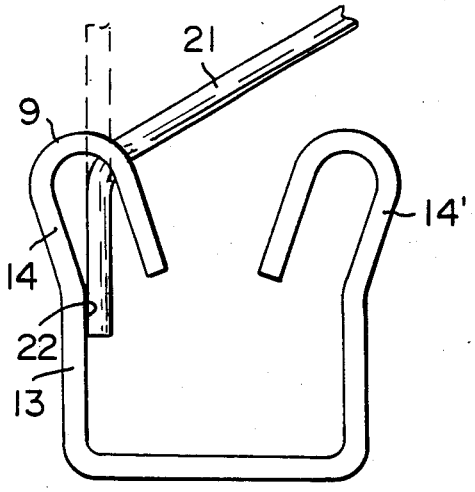
FIG. 2 is an end view of the first terminal at a first stage of wire termination.
Figure 3:
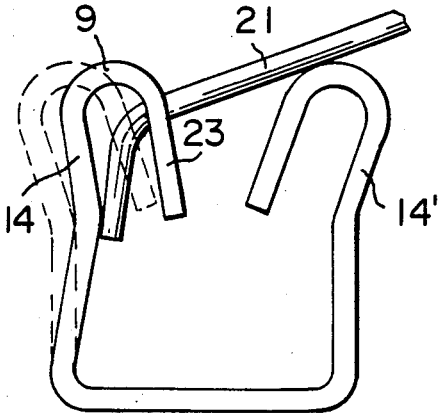
FIG. 3 is a similar view to FIG. 2 at a later stage of wire terminating.

As shown in FIG. 2, in use of the terminal, a free end of a wire 21 is threaded through a mouth and the wire drawn across the terminal towards the slots. Engagement of the threaded end of the wire with the surface 22 of the upstanding wall 13 and engagement with the adjacent slot in the returned tip 23 of the fold with resistance to insertion causes the end to be bent to hook shape and to be trapped in the fold while the adjacent wire portion is drawn into the slot. The wall portions 13 and 14 are also pulled by the wire towards the opposite wall portions 13′ and 14′ with expansion of the bight as shown in FIG. 3. The wire is then completely terminated by drawing into the slots 15′ in wall portion 14′.

Figure 4:
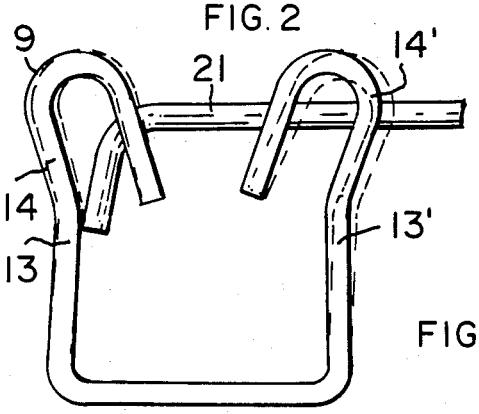
FIG. 4 is a similar view to FIG. 2 after complete wire termination.

Release of the wire causes the terminal to assume the configuration shown in FIG. 4 with partial return of wall portion 13 towards the undeformed state of FIG. 2, causing wall portions 13′ and 14′ to be resiliently flexed towards wall portion 13 by the residual tension in the wire. The residual spring forces assist in retaining the wire in the slot, and maintaining a good electrical termination.

The wires may easily be released from the terminal by finger pressure to lift the wire out from the slots 13 and 13′. In some instances, it may be desirable to bend the end of the wire into hook shape prior to insertion in the bight.

In view of the identical construction of wall portions 13 and 13′, the wire may conveniently be terminated by initial insertion of the end of either fold.

Figure 6:
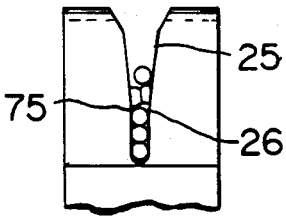
FIG. 6 is a similar view to FIG. 5 showing an alternative wire receiving slot.

In a preferred construction, shown schematically in FIG. 6, the convergent slot edges 25 extend to parallel edges 26 at a blind end of a slot. This configuration facilitates connection to either solid or stranded wires of different types and gauges. In one example, during insertion of stranded wire, some individual strands separate and align in a single row gripped by the parallel edges. A solid wire, however, will remain gripped between the convergent edges.

Figure 7:
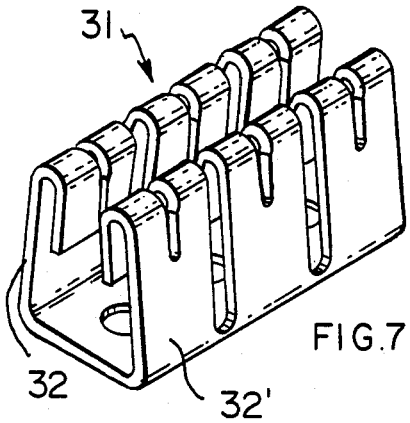
FIG. 7 is a perspective view of a second example of terminal according to the invention.
Figure 9:
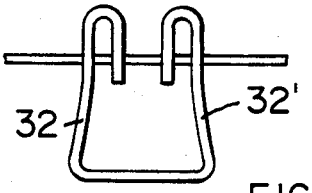
FIG. 9 is a similar view to FIG. 8 after final termination.

The terminal 31 shown in FIG. 7, is modified in that the channel side walls 32, 32' are convergent. This is primarily intended for termination using tooling rather than by hand as the wire is usually forced into all slots simultaneously producing a greater resistance to insertion than in the first example. During insertion, the side walls bow towards each other as shown in FIG. 9 and remain in resiliently flexed condition, tensioning the wire.

Figure 10:
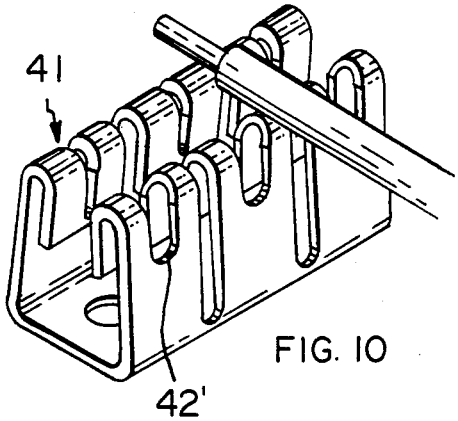
FIG. 10 is a perspective view of a third example of terminal for plastics insulated wire; and, FIG. 11 is an end view of the third example of terminal after final termination of a wire therein.
Figure 8:
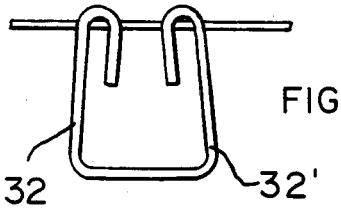
FIG. 8 is an end view of the second terminal during a first stage of wire termination.
Figure 11:
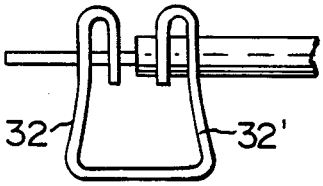

The terminal 41 shown in FIG. 10, has wider slots 42' on one side of each bight than the other for providing strain relief on insulated wire. The termination is effected in a similar way to that for terminal 31 as shown in FIG. 11.

I claim:

1. An electrical connection comprising a stamped and formed, one piece, metal terminal of substantially channel section, portions of the channel walls remote from the base being relatively divergent as they extend away from the base and having, respectively, wire-receiving slots extending towards the base from mouths remote from the base; a wire received as a force fit in respective slots to extend across the channel in tension with the wall portions resiliently flexed towards each other by the wire, an end of the wire extending from a slot in hooked fashion.

2. An electrical connection according to claim 1 in which the relatively divergent channel wall portions are provided at free ends of parallel channel wall portions.

3. An electrical connection according to claim 1 in which a wall portion is folded back towards the base at a free end, the hooked wire end being received in the fold.

4. An electrical connection according to claim 1 in which at least one of the slots have wire gripping opposite edges which converge as they extend away from the mouth.

5. An electrical connector according to claim 4 in which the one slot has parallel wire gripping opposite edges at blind ends remote from the mouths.

6. An electrical terminal stamped and formed in one piece of metal into substantially channel section, portions of the channel walls remote from the channel base having, respectively, wire-receiving slots extending towards the base from mouths remote from the base, one of the wall portions being folded back at a free end, whereby an end of a wire can be inserted through a slot mouth into the fold, and the wire drawn across and into the channel bending the end into hook form and inserting the wire into both slots as a force fit with resilient flexure of the wall portions relatively towards each other by the wire.

7. An electrical terminal according to claim 6 in which at least one of the slots has opposite wire gripping edges which converge as they extend away from the mouth.

8. An electrical terminal according to claim 6 in which the channel wall portions are convergent as they extend away from the base.

9. An electrical terminal according to claim 8 in which the channel base is adapted to be secured to a support.

10. An electrical terminal according to claim 6 in which the channel wall portions are divergent as they extend away from the base.

11. An electrical terminal according to claim 10 in which the other wall portion is folded back towards the base.

12. An electrical terminal according to claim 10 in which the relatively divergent channel wall portions are provided at free ends of parallel channel wall portions.

13. An electrical terminal according to claim 12 in which the one slot has parallel wire gripping edges at blind ends remote from the mouths.

14. An electrical terminal stamped and formed in one piece of metal into substantially channel section, portions of the channel walls adjacent the base being parallel and portions of the channel walls remote from the channel base being relatively divergent as they extend away from the base and having, respectively, wire-receiving slots extending towards the base from mouths remote from the base, the divergent wall portions being folded back towards the base at free ends, through which folds the slots extend.

15. An electrical terminal according to claim 14 in which the slots have opposite, wire gripping edges which converge as they extend away from the mouth.

16. A one piece electrical terminal which comprises a plurality of axially spaced identical wire receiving sections each according to claim 14 and mechanically isolated from each other by apertures extending for substantially the entire height of the channel walls.

17. An electrical terminal stamped and formed in one piece of metal into substantially channel section, the channel walls being relatively convergent as they extend away from the base and having respectively, wire-receiving slots extending towards the base from mouths remote from the base, the convergent wall portions being folded back towards the base at free ends through which folds the slots extend.

18. An electrical terminal according to claim 17 in which the slots have opposite wire gripping edges which converge as they extend away from the mouth.

19. A one piece electrical terminal which comprises a plurality of axially spaced, identical wire receiving sections each according to claim 17 and mechanically isolated from each other by apertures extending for substantially the entire height of the channel walls.

* * * * *